United States Patent [19]

Grob et al.

[11] Patent Number: 4,718,015

[45] Date of Patent: Jan. 5, 1988

[54] METHOD AND APPARATUS FOR CONTROLLING AN INTERNAL COMBUSTION ENGINE

[75] Inventors: Ferdinand Grob, Besigheim; Josef Wahl, Stuttgart, both of Fed. Rep. of Germany

[73] Assignee: Robert Bosch GmbH, Stuttgart, Fed. Rep. of Germany

[21] Appl. No.: 735,973

[22] Filed: May 20, 1985

[30] Foreign Application Priority Data

Aug. 10, 1984 [DE] Fed. Rep. of Germany ..... 3429525

[51] Int. Cl.[4] ..... F02M 51/00

[52] U.S. Cl. ..... 364/431.05; 123/436

[58] Field of Search ..... 364/431.05, 431.03; 123/489, 419, 436

[56] References Cited

U.S. PATENT DOCUMENTS

| | | | |
|---|---|---|---|
| 4,301,780 | 11/1981 | Hoshi | 123/483 |
| 4,387,429 | 6/1983 | Yamauchi et al. | 364/431.05 |
| 4,483,300 | 11/1984 | Hosaka et al. | 123/489 |
| 4,489,690 | 12/1984 | Burkel et al. | 123/419 |
| 4,495,920 | 1/1985 | Matsumura et al. | 123/436 |
| 4,532,592 | 7/1985 | Citzon et al. | 364/431.05 |

FOREIGN PATENT DOCUMENTS

| | | | |
|---|---|---|---|
| 2034930 | 6/1980 | United Kingdom | 123/436 |

*Primary Examiner*—Parshotam S. Lall
*Attorney, Agent, or Firm*—Walter Ottesen

[57] ABSTRACT

The invention is directed to a method for the cylinder-group specific control of a multi-cylinder internal combustion engine and an apparatus for carrying out the method for cylinder-group specific optimization of the efficiency of the internal combustion engine. The control strategy includes a first step for generating time-dependent signals to influence the air ratio lambda of the air-fuel mixture supplied to at least any two cylinder groups each made up of at least one cylinder. The air ratio lambda is influenced such that the air ratio is modified in a cylinder-group specific manner and that the mean air ratio of the air-fuel mixture supplied to all cylinders is maintained constant. A second step follows to detect the reaction of the internal combustion engine to the signals of the first step, this reaction manifesting itself in a modification of an output quantity. Then follows a third step to influence the efficiency of the individual cylinder groups of the internal combustion engine in accordance with the results of the second step. This ensures that each cylinder group or each cylinder receives an air-fuel mixture having an air ratio at which efficiency is at a maximum. For a given engine design and for given operating conditions, it is thus possible for the engine to operating in the range of theoretically minimum fuel consumption.

22 Claims, 10 Drawing Figures

Divider
Oscillator
59
58
$f_1/n$
$f_1$
Timer
54
I/O
56
78
77
Power Output Stage
51
CPU
ROM
53
RAM
52
Address and Data Bus
57
55
I/O
Microcomputer
50
A/D Converter
75
76
74
Multiplexer
Conditioning Circuit
60
Conditioning Circuit
61
62
70
Conditioning Circuit
71
72
Conditioning Circuit
73
Conditioning Circuit
Exhaust-Gas Sensor
63
64
65
Conditioning Circuit
66
67
Conditioning Circuit
68
69
Torque Sensor

METHOD AND APPARATUS FOR CONTROLLING AN INTERNAL COMBUSTION ENGINE

FIELD OF THE INVENTION

The invention relates to a method for the open and/or closed loop control of a multi-cylinder internal combustion engine and an apparatus for carrying out the method. The method controls the operating quantities of a multi-cylinder engine to optimize the efficiency of the engine.

BACKGROUND OF THE INVENTION

An apparatus of the type referred to above is described in U.S. Pat. No. 4,489,690. To optimize the torque delivered by an internal combustion engine or the specific fuel consumption, a test signal generator for varying the amount of fuel metered and a sensor for detecting the quantity to be optimized are utilized. On the basis of a torque signal, the maximum power or the minimum specific fuel consumption are determined depending on the load range of the internal combustion engine. While such arrangements have proven well in practice, further developments and improvements are still possible, particularly with a view to more stringent emission control legislation and efforts to lower the fuel consumption of internal combustion engines.

Thus, for example, investigations have shown that the individual cylinders of an internal combustion engine are normally operated with different air-fuel ratios. The reasons for this are, among others, differences in intake ducting and injection valves which are not fully identical.

SUMMARY OF THE INVENTION

It is therefore an object of the invention to meter to each individual cylinder of the internal combustion engine precisely the control quantities it needs to operate at optimum efficiency for the particular operating point.

The invention affords a substantial advantage in that it results in a reduced consumption of fuel by the internal combustion engine while maintaining good emission values in spite of larger permissible tolerances for the injection valves and the charging of the individual cylinders. Further, it is shown to be an advantage that the invention permits the air ratio lambda to be adjusted for each cylinder to a value at which this particular cylinder operates at optimum efficiency. Therefore, for a given engine design and for given operating conditions, the engine can therefore be operated in the range of theoretically minimum fuel consumption.

Further advantages of the invention will become apparent from the subsequent description in conjunction with the drawing and from the claims.

BRIEF DESCRIPTION OF THE DRAWING

The invention will now be described in greater detail with reference to the drawing wherein.

DESCRIPTION OF THE PREFERRED EMBODIMENTS OF THE INVENTION

Arrangements for the optimization of operating characteristics of an internal combustion engine which do not act in a cylinder-specific manner will not be discussed in the following since their operation is sufficiently explained, for example, in U.K. Pat. No. 20 34 930B, SAE Paper 72 02 54 and U.S. Pat. No. 4,064,846. Generally, these methods are based on an extreme-value control wherein an input quantity of the internal combustion engine is varied periodically, for example. The reaction of the internal combustion engine to this periodic variation is monitored via an output quantity of the internal combustion engine which may be the torque, for example. According to the result of this monitoring operation, an input quantity of the internal combustion engine continues to be adjusted until the variation of the output quantity is reduced to a minimum. In all known methods, however, the fact that, as a rule, each individual cylinder of the internal combustion engine is provided with a different air-fuel mixture remains unconsidered. The reasons why the air-fuel mixture varies for individual cylinders are, for example, different charges or different amounts of fuel injected.

Figure 1:
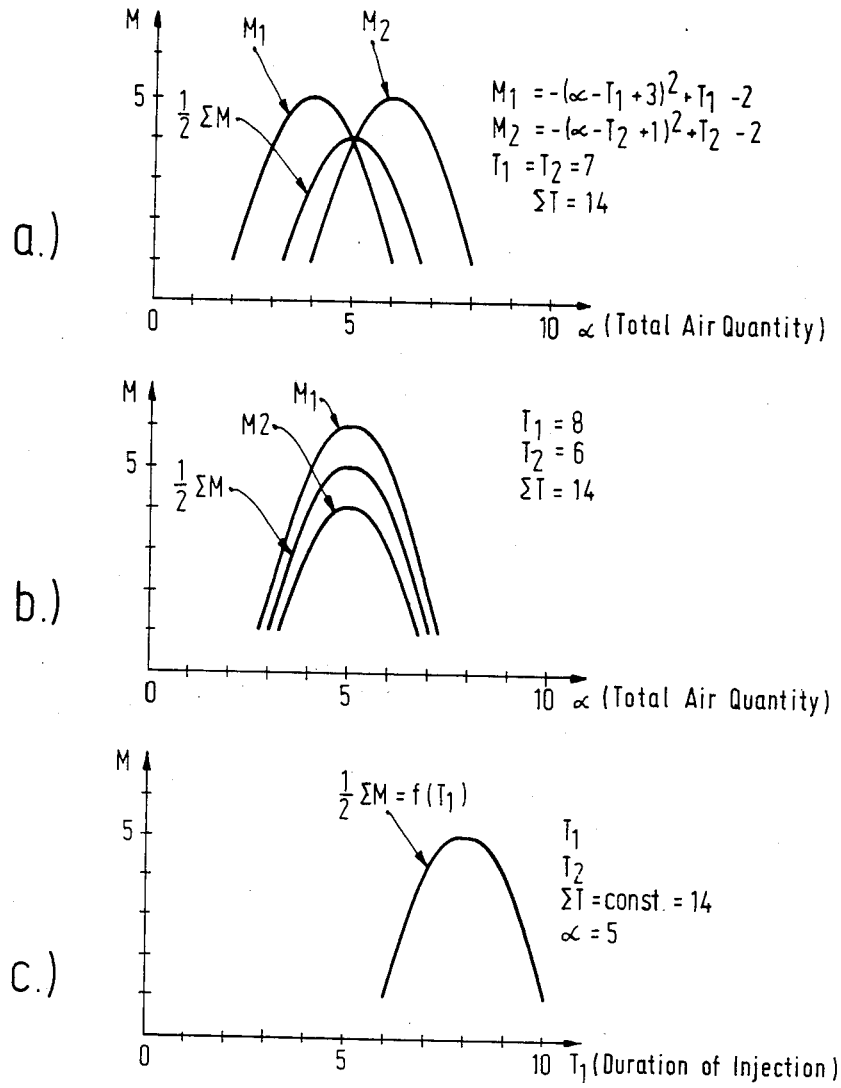
FIGS. 1*a*–1*c* and 2*a*–2*c* are diagrams showing arbitrarily assumed torque characteristics of the cylinders of an internal combustion engine to explain the method of the invention.

The invention will now be explained in more detail by way of example with reference to a two-cylinder internal combustion engine. For this purpose, FIG. 1*a* shows two torque characteristics $M_1$ and $M_2$ of two individual cylinders plotted in dependence upon the throttle flap position $\alpha$ and thus in dependence upon the amount of air inducted. The torque characteristics $M_1$ and $M_2$ are assumed to be different for the two cylinders. To simplify the numerical treatment of this problem, the torque characteristic was arbitrarily assumed to be parabolic as follows:

$$M_1 = -(\alpha - T_1 + 3)^2 + T_1 - 2$$

$$M_2 = -(\alpha - T_2 + 1)^2 + T_2 - 2$$

wherein $\alpha$ is the throttle flap position or the amount of air inducted, and $T_1$, $T_2$ are the durations of injection for the individual cylinders.

For reasons of clarity, all further FIGS. do not show the total torque as a sum of the individual torques but the total torque divided by the number of cylinders. In these curves, the duration of injection enters as a parameter. The special selection of the torque characteristics of the individual cylinders simulates that cylinder 1 receives a greater charge than cylinder 2. This is attributable to the fact that for identical durations of injection $T_1 = T_2 = 7$ (arbitrary units), the torque characteristic curve of the first cylinder attains its torque maximum already at a throttle position $\alpha = 4$ (arbitrary units) as against $\alpha = 6$ (arbitrary units) for the second cylinder. In view of such different charges of the individual cylinders, the total torque ($\frac{1}{2}\ \Sigma M$) related to the number of cylinders at a throttle position $\alpha = 5$ (arbitrary units) cannot attain the values of the individual cylinder torques.

In order to optimize the torque characteristic of individual cylinders or the cylinder-specific efficiency, the invention provides that the amount of fuel injected for the two cylinders of the internal combustion engine be varied in opposition to each other while the amount of air inducted remains constant, the amount of injected fuel being wobbled such that the total duration of injection or quantity of fuel injected for all cylinders is maintained constant. A comparison of the phase positions of the wobble signal for the durations of injection with the signal of an engine torque sensor supplies the cylinder-specific durations of injections to attain the maximum torque of the internal combustion engine. On the basis of the results of the phase comparison, the cylinder-specific quantities of fuel injected continue to be varied in opposition to each other until the torque variations assume a minimum as a result of the wobbling of the durations of injection.

The essential boundary condition of this method is to keep the sum of the individual durations of injection constant in order to maintain both the operating point of the internal combustion engine and the mean exhaust-gas composition. The results of such a cylinder-specific optimization process are shown in FIG. 1*b*. According to this process, cylinder 1, which has a higher volumetric efficiency than cylinder 2 while the throttle flap position $\alpha$ is the same, receives a larger amount of fuel corresponding to a duration of injection $T_1=8$ (arbitrary units); whereas, the duration of injection for cylinder 2 is $T_2=6$ (arbitrary units). Accordingly, while the sum of the durations of injection and thus the amount of fuel injected remained unchanged, the cylinder-related total torque ($\frac{1}{2}\ \Sigma M$) experiences a 25% increase from 4 (arbitrary units) to 5 (arbitrary units). This means that the efficiency of the internal combustion engine would be increased by 25%.

To illustrate the relationships, FIG. 1*c* shows the characteristic of the cylinder-weighted total torque plotted against the duration of injection $T_1$. The throttle flap position $\alpha$ serves as a parameter, with $\alpha$ assuming 5 (arbitrary units) in this embodiment. The duration of injection $T_2$ is implicit in the total torque function because of the condition that the sum $\Sigma T$ of the durations of injection $T_1$ and $T_2$ is to form a constant (constant=14 in the present embodiment). It will be seen from FIG. 1*c* that the two-cylinder internal combustion engine will deliver an optimum torque and will consequently be operated at maximum efficiency if the duration of injection $T_1$ assumes the value 8 (arbitrary units) at a total duration of injection $T_1$ and $T_2$ of 14 (arbitrary units) with a throttle flap position $\alpha=5$ (arbitrary units). This process is then repeated for each throttle flap position.

Figure 2:
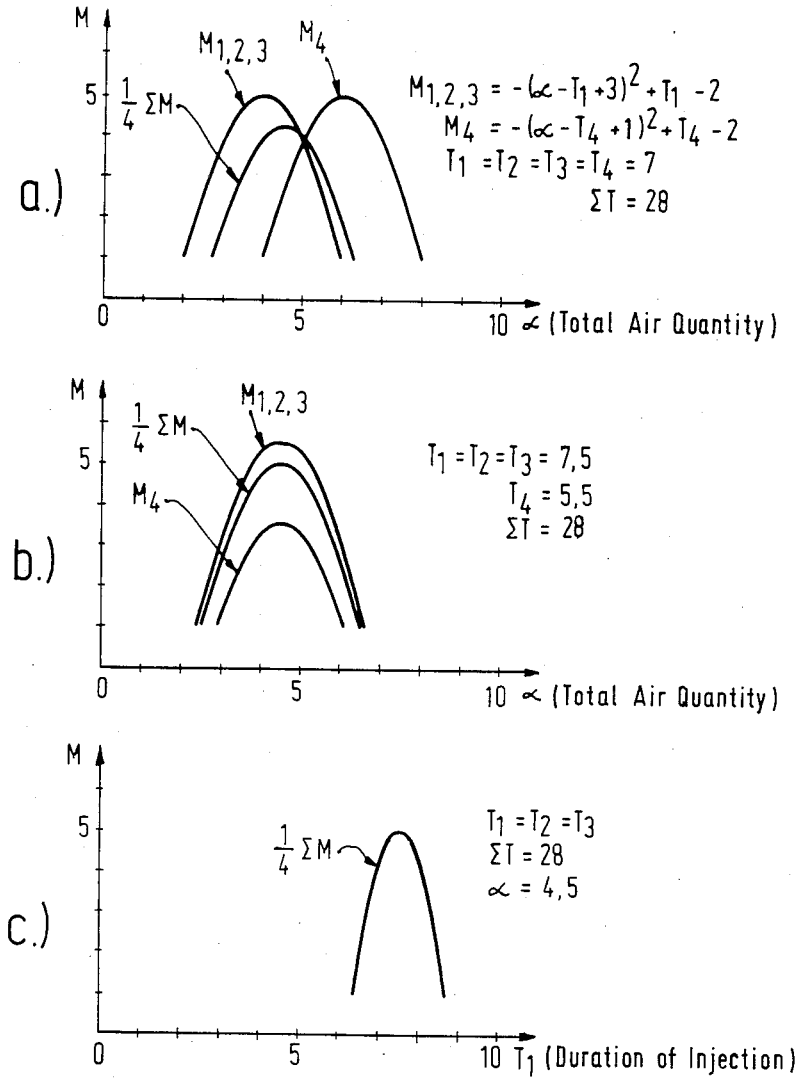

The method for a four-cylinder internal combustion engine will now be explained with reference to FIG. 2. By analogy to FIG. 1*a*, FIG. 2*a* shows the torque characteristics of individual cylinders as well as the cylinder-related total torque characteristic. In this connection, it was assumed that cylinders 1, 2 and 3 have identical charges and accordingly identical torque characteristics $M_{1,2,3}$. Cylinder 4, however, operates with a lower volumetric efficiency so that the torque maximum is not attained until larger throttle flap positions $\alpha$ or air quantities are reached. The arbitrarily assumed torque characteristics of the individual cylinders are to satisfy the following equations:

$$M_{1,2,3}=-(\alpha-T_1+3)^2+T_1-2$$

$$M_4=-(\alpha-T_4+1)^2+T_4-2$$

wherein: $T_1=T_2=T_3=T_4=7$.

The optimization process then proceeds such that first the durations of injection or quantities of fuel injected ($T_1+T_2$) for cylinders 1 and 2 are wobbled in opposition to the durations of injection ($T_3+T_4$) for cylinders 3 and 4. Here, too, the boundary condition is to be maintained that the sum of all four durations of injection is to remain unchanged. Wobbling the amount of fuel injected in connection with an observation of the phase of the output signal for the torque or speed of the internal combustion engine serves to set the direction of the necessary adjustment of the mean values of ($T_1+T_2$) and ($T_3+T_4$) such that a maximum torque results, that is, that the torque modulation goes toward zero value. The determined ratios of the amounts of fuel injected $T_1$, $T_2$ and $T_3$, $T_4$ are initially stored away. The process described is then repeated in the same manner for two further cylinder groups or cylinders. By alternately combining the cylinders or cylinder groups and repeating the optimization process, after a few steps, the absolute torque maximum or the absolute minimum specific fuel consumption is set for the relevant operating point of the internal combustion engine. The result may be stored, for example, in a learning or self-adaptive characteristic.

Alternating the cylinder groups or single cylinders is necessary because each individual optimization process is only capable of determining the ratio of two amounts of fuel injected. In the case of a four-cylinder internal combustion engine, four unknown quantities, that is, four durations of injection, have to be established. Therefore, the optimization process has to be repeated three times, providing three different durations of injection ratios for different cylinder groups or cylinders. The fourth condition utilized is that the sum of all durations of injection has to assume a constant value. To determine the four unknown quantities, that is, the four durations of injection for each individual cylinder, four equations are therefore available (three durations of injection ratios, sum $T_1$=constant) so that the computation of the durations of injection for the individual cylinders can take place without difficulty. If it is established in the particular case that a coupling exists between the variables, that is, that there are no four independent variables, it is appropriate to alternatively determine the cylinder-specific durations of injection. Several repetitions of the optimization process described will then yield the same result after a few passes. Such iterative methods for the solution of coupled equation systems are well known per se so that those in the art are in a position to perform the method of the invention also iteratively.

FIG. 2*b* shows the result of the optimization process, that is, durations of injection $T_1=T_2=T_3=7.5$ (arbitrary units), and $T_4=5.5$ (arbitrary units) for a throttle flap position $\alpha=4.5$ (arbitrary units). In this example, too, an approximately 20% increase is obtained in the mean total torque per cylinder. By analogy to FIG. 1*c*, FIG. 2*c* shows the dependency of the mean total torque per cylinder as a function of the duration of injection $T_1$ for a specific throttle flap position $\alpha=4.5$ (arbitrary units). The durations of injection $T_2$, $T_3$ and $T_4$ are implicitly maintained via the conditions $T_1=T_2=T_3$ and $$\sum_{i=1}^{4} (T_i) = \text{constant.}$$

The extreme value of this characteristic is at a duration of injection $T_1=7.5$ (arbitrary units) so that the optimum values for the durations of injection of FIG. 2*b* are confirmed which is as expected.

By analogy, the individual procedural steps apply to an internal combustion engine having a number of cylinders not considered in this description, the only difference being that the number of steps and the alternation of cylinders or cylinder groups wobbled in opposition to each other change.

Figure 3:
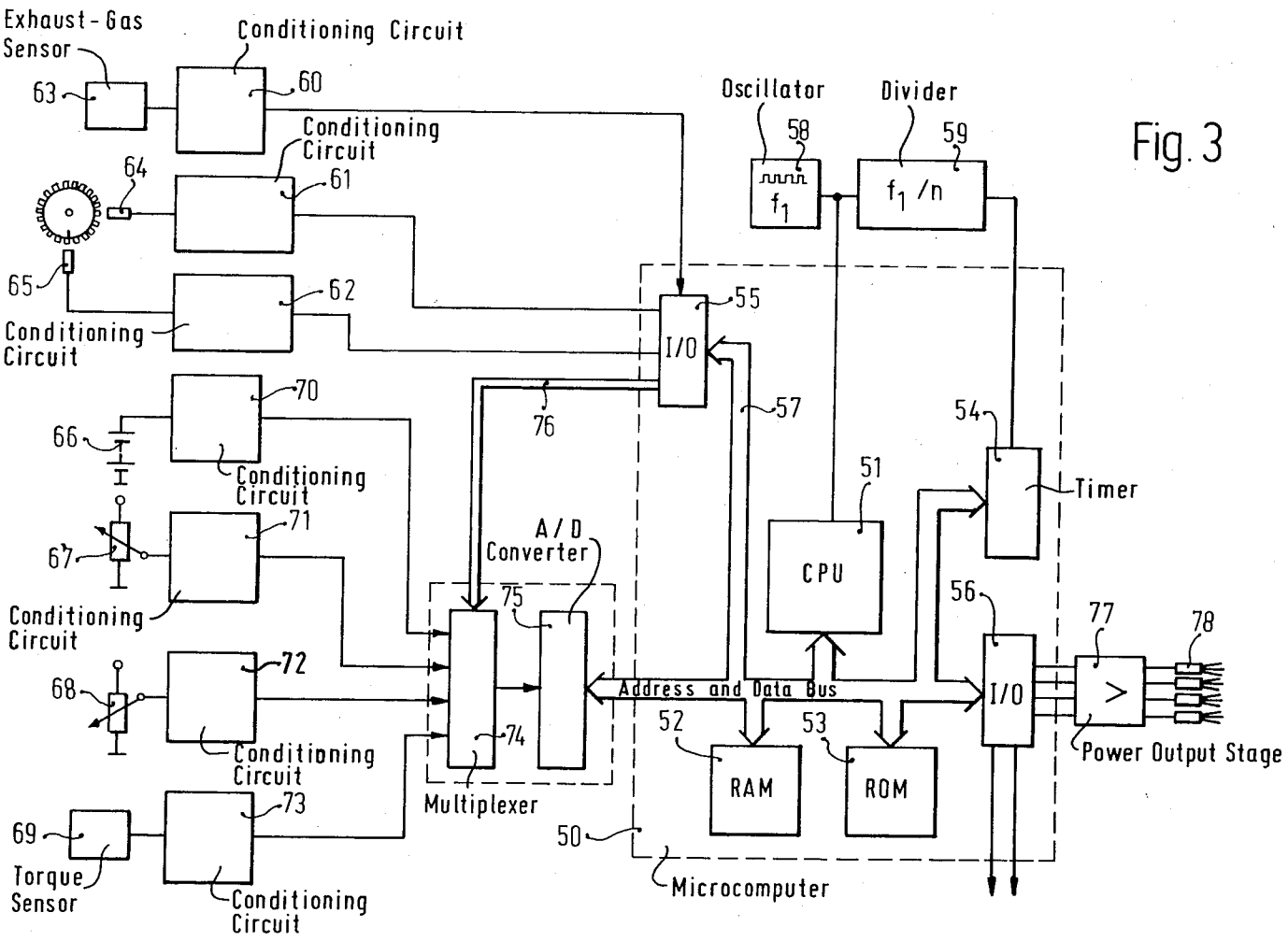
FIG. 3 is a block diagram illustrating an embodiment of the apparatus for carrying out the method.

FIG. 3 shows the circuit configuration of an apparatus for carrying out the optimization process described. In a microcomputer 50, the components CPU 51, RAM 52, ROM 53, timer 54, first I/O unit 55 and second I/O unit 56 are interconnected via an address and data bus 57. For timing the program flow in the microcomputer 50, an oscillator 58 is used which is connected to the CPU 51 directly and to the timer 54 via a divider 59. The signals of an exhaust gas sensor 63, of a speed sensor 64 and of a reference mark detector 65, for example, are applied to the first I/O unit 55 via conditioning circuits 60, 61 and 62, respectively. Further input quantities are the battery voltage 66, the throttle flap position 67, the coolant temperature 68 and the output signal of torque sensor 69. If the torque of the internal combustion engine is obtained from the engine speed directly, it is also possible to use the speed sensor 64 for torque detection.

These input quantities are connected to a circuit including a multiplexer 74 and an analog-to-digital converter 75 connected in series via respective conditioning units 70, 71, 72 and 73. The functions of multiplexer 74 and analog-to-digital converter 75 may be carried out by a component of National Semiconductor having the number 0809. Multiplexer 74 is controlled via a line 76 leading from the first I/O unit 55. The second I/O unit 56 controls the injection valves 78 of the internal combustion engine via power output stages. For the application of the method of the invention, it is irrelevant whether the fuel is injected by an injection system having one injection valve per cylinder or by an injection system having a single injection valve arranged in the air intake pipe of the internal combustion engine.

Figure 4:
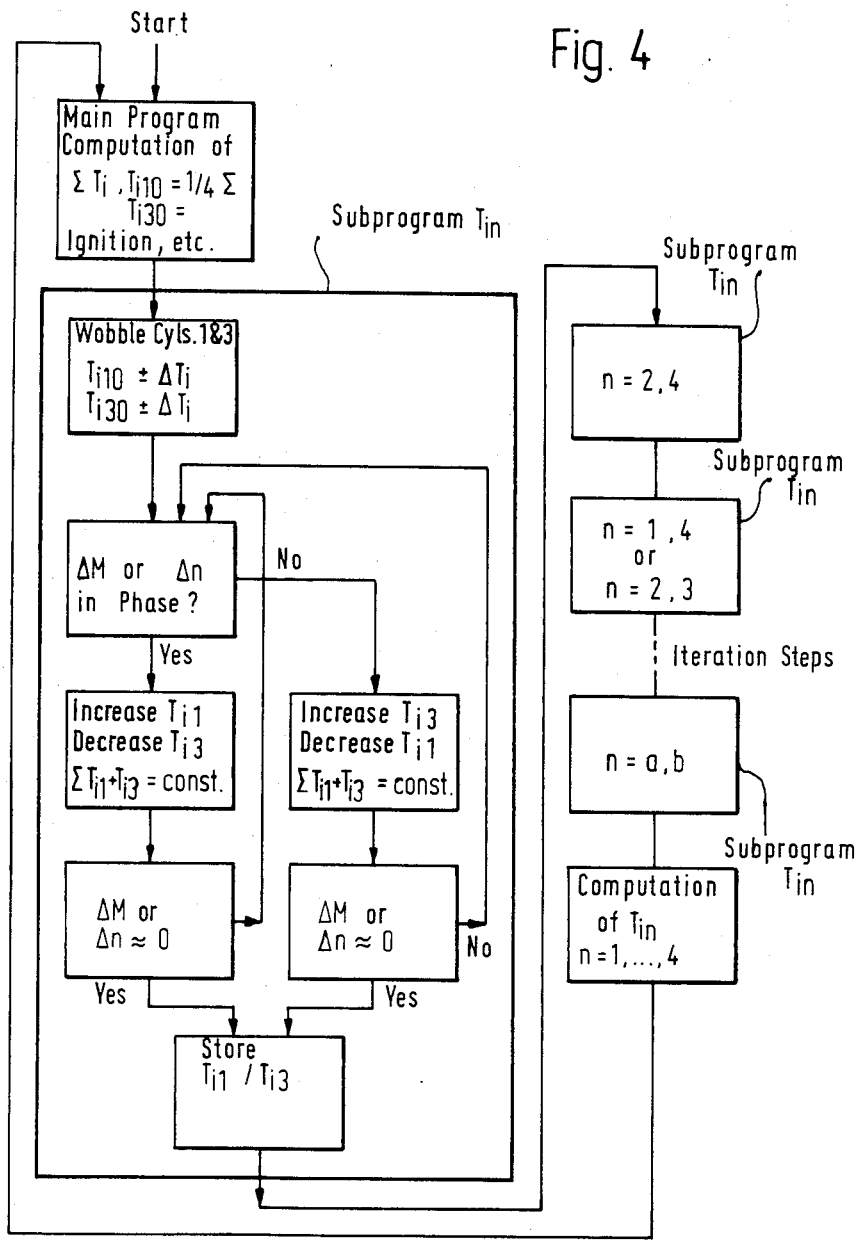
FIG. 4 is a flowchart to explain the operation of the embodiment of FIG. 3.

The mode of operation of the apparatus described depends to a substantial extent on how the microcomputer is programmed. U.S. Pat. No. 4,616,618 describes in detail the program flow for fuel metering in an internal combustion engine and is incorporated herein by reference. The description includes anticipatory control, extreme-value control and a characteristic learning process. Therefore, the following description will be limited to those method steps which are typical of a cylinder-specific optimization. The method steps will be explained with reference to the block diagram of FIG. 4.

After the ignition is turned on, the operating parameter dependent amounts of fuel injected or durations of injection are determined in the main program or are read out of a characteristic in the main program. In this connection, identical durations of injection $T_{ino}$ are at first assumed for each cylinder n of the internal combustion engine. The ignition points and other quantities are computed in the main program.

The cylinder-specific optimization of fuel metering or of efficiency occur in the subprogram $T_{in}$. First the durations of injection $T_{i10}$, $T_{i30}$ or, for example, cylinders 1 and 3 of the internal combustion engine are varied in opposition to each other by the amount $\Delta T_i$. After a phase comparison between the torque change or speed change and the wobble signal of, for example, cylinder 1 is made, the durations of injection of the individual cylinders are modified in accordance with the comparison result under the boundary condition that the total duration of injection be constant. Then an inquiry is made as to whether the torque or speed change caused by the wobbling of the duration of injection approximates zero value or has dropped below a predetermined lower threshold value. If this is the case, the ratio of the durations of injection for the first and third cylinder is stored away. If the torque change is still above a predetermined threshold value, the cylinder-specific durations of injection are correspondingly modified after another phase comparison is made. In the variation of the cylinder-specific durations of injection, a boundary condition always to be considered is that the sum of the durations of injection, in the present example $T_{i1}$ and $T_{i3}$, is to assume a constant value.

In the next step, the durations of injection of cylinders 2 and 4, for example, are optimized in accordance with subprogram $T_{in}$, the durations of injection being stored as a ratio in a memory store. Following another optimization of a third combination of individual cylinders or individual cylinder groups, in the present embodiment either cylinders 1 and 4 or cylinders 2 and 3, sufficient information is available for the computation of the cylinder-specific durations of injection. The dotted line identified by "Iteration Steps" indicates that the optimization process may be carried out more frequently than shown for iterative approximation of the cylinder-specific durations of injection. Ideally, a n-cylinder internal combustion engine requires (n−1) optimization processes for different cylinders or cylinder groups. This will become apparent from the following brief example applicable to a four-cylinder internal combustion engine:

1st Optimization: $T_{i1}/T_{i3}=\text{Constant } 1$
2nd Optimization: $T_{i2}/T_{i4}=\text{Constant } 2$
3rd Optimization: $T_{i2}/T_{i4}=\text{Constant } 3$ (The third optimization could also be performed alternatively with the durations of injection $T_{i2}$, $T_{i3}$.)

$$T_{i1}+T_{i2}+T_{i3}+T_{i4}=\text{Constant } 4.$$

For the four unknown durations of injection of individual cylinders, four independent and easily resolvable equations are thus available due to the three optimization processes and the summation condition.

In order to ensure that the operating conditions of the internal combustion engine are approximately constant during the optimization process, suitable inquiry devices known per se are provided which interrupt or restart the optimization process in the event of excessive variations.

Figure 5:
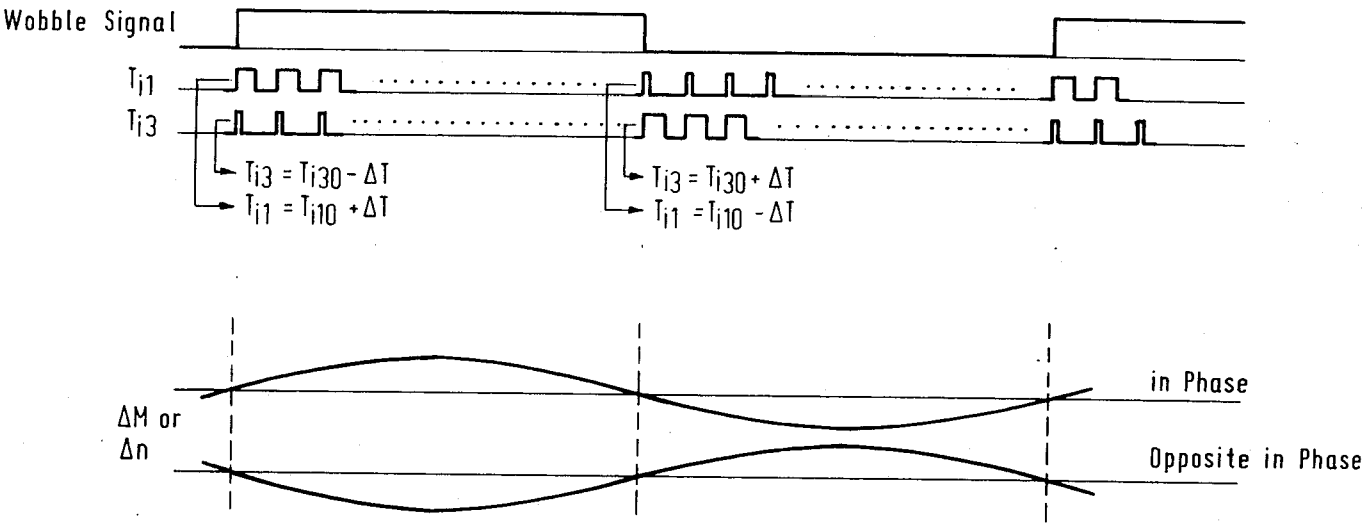
FIG. 5 is a diagram showing some essential signal quantities as a function of time; and, FIG. 6 is a timing diagram to explain the application of the method of the invention to a multi-cylinder internal combustion engine having only one individual injection valve.

FIG. 5 shows the wobble signals determined by an optimization process of the durations of injection $T_{i1}$, $T_{i3}$, together with the respective torque or speed signals. For a predetermined time period $\tau$ dependent, for example, on operating parameters, the duration of injection $T_{i1}$ is increased by an amount $\Delta T$ while the duration of injection $T_{i3}$ is decreased by an amount $\Delta T$. The internal combustion engine may react to these modified durations of injection by a torque increase or decrease. Depending on whether the increase in the duration of injection for cylinder 1 causes a torque increase (in phase) or a torque decrease (opposite in phase), the duration of injection $T_{i1}$ ($T_{i3}$) is increased (decreased) or decreased (increased) under the boundary condition of a constant total duration of injection ($T_{i1}+T_{i3}$). After the first time period $\tau$ has elapsed, the optimization process continues in a manner which results in a decrease in the duration of injection $T_{i1}$ by an amount $\Delta T$ and in increase in the duration of injection $T_{i3}$ by an amount $\Delta T$. The phase of the torque change of the internal combustion engine also changes correspondingly. To evaluate the phase position between the wobble signal of the duration of injection and the torque or speed change resulting therefrom, digital filters may be utilized advantageously as described in U.S. Pat. No. 4,616,618 referred to above.

Figure 6:
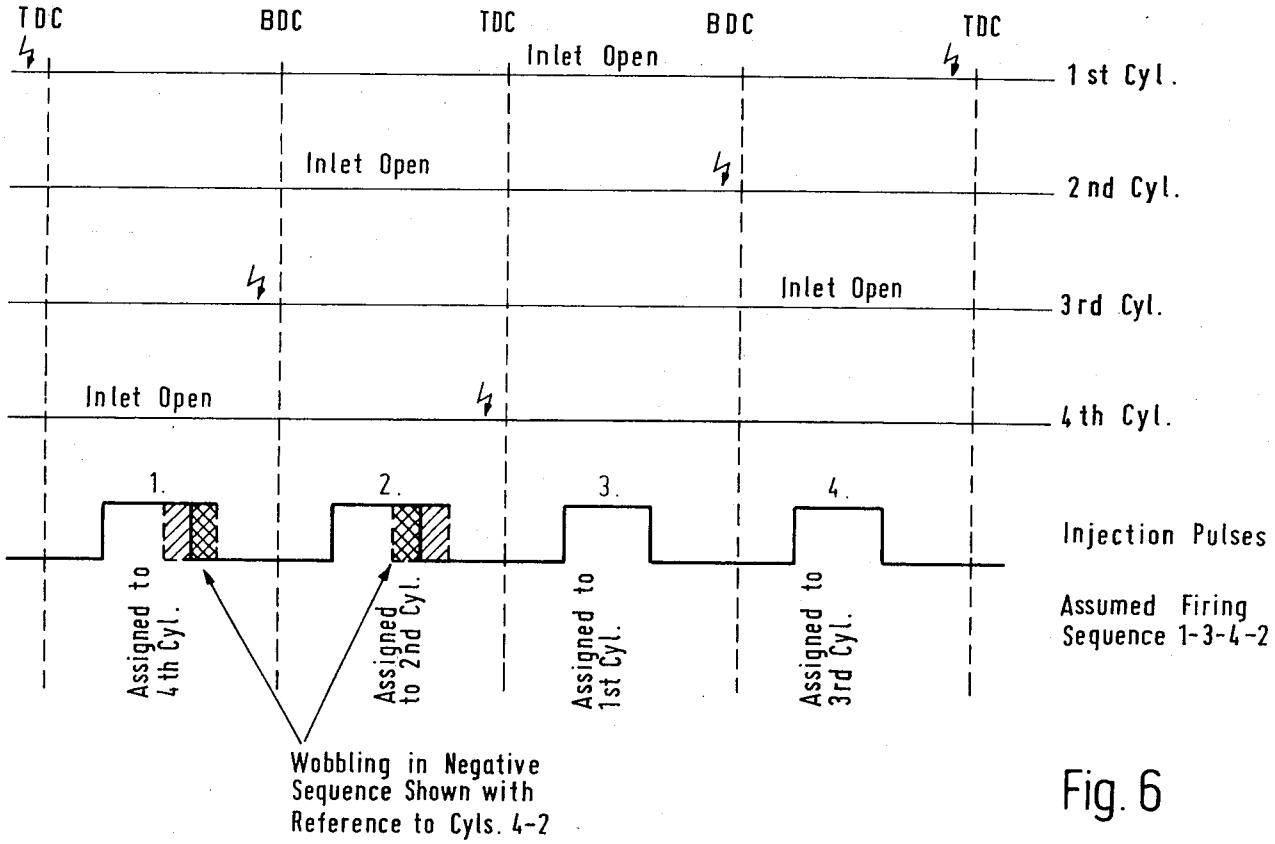

While the applications so far described always related to an internal combustion engine with individual cylinder injection, application of the invention to an internal combustion engine having one single central injection valve will now be described briefly with reference to FIG. 6. The diagram of FIG. 6 shows the ignition time points, the opening periods of the intake valves and the injection pulses for the central injection valve plotted as a function of the crank shaft angle. The firing sequence for cylinders 1 to 4 was assumed to be 1-3-4-2. The injection process has to be synchronized such that each cylinder can be assigned an injection pulse or that the major part of the fuel supplied per injection pulse goes to one individual cylinder.

In this example, the first injection pulse occurs at a point in time which is chosen such that, after expiration of its travel time (from injection valve to intake valve), the pulse arrives at the fourth cylinder precisely at the instant that the intake valve of this particular cylinder opens. The second injection pulse appears at the second cylinder in the same manner. It may prove necessary in practice to shift the beginning of injection in dependence on operating parameters in order to take the travel times from the injection valve to the intake valve into account. With a given total amount of fuel injected per two revolutions, it is now possible to vary the amount of fuel allocated to the individual cylinder. The injection pulses for two cylinders or cylinder groups are again wobbled in opposition to each other and varied in their mean value in opposition to each other such that a maximum torque results as already described.

The proposed cylinder optimization may be used at any operating point of the internal combustion engine including, of course, also the $P_{min}$ or $P_{max}$ operating point. By means of a higher-order control system using, for example, a lambda sensor, it is also possible to adjust the air ratio lambda, which is averaged over all cylinders, to a specific value. This specific value may be predetermined in dependence on operating parameters. As already described in the foregoing, the maximum efficiency of the internal combustion engine is then determined by means of the single cylinder optimization process for this operating point.

Of particular interest with a view to future emission control legislation are the operating points at lambda=1. In a manner known per se, the higher-order control system will then keep the mean air ratio at lambda=1 by means of a (lambda=1)-sensor. By means of a single cylinder optimization, it is then possible to accurately adjust the air ratio lambda for each cylinder to a value at which it operates at maximum efficiency. Considering that without optimization the $\Delta$ lambda tolerances in the lambda value from cylinder to cylinder may easily be of the order of $\Delta$ lambda $\sim 0.1$, a substantially reduced width of fluctuation is to be expected after an optimization. Moreover, a reduced width of fluctuation of the lambda value from cylinder to cylinder would afford advantages regarding the dimensions of catalysts because current catalysts are built to rather large dimensions as a result of these fluctuations in order to average over several combustion strokes of the internal combustion engine.

It is understood that the foregoing description is that of the preferred embodiments of the invention and that various changes and modifications may be made thereto without departing from the spirit and scope of the invention as defined in the appended claims.

What is claimed is:

1. Method for controlling operating characteristic quantities of a multi-cylinder internal combustion engine with a control strategy for optimizing the efficiency of the engine, the method and control strategy comprising:

a first step of generating time dependent signals for modifying the air ratio lambda of the operating mixture conducted to at least any two desired groups of cylinders wherein each group includes at least one cylinder, said air ratio lambda being modified for one cylinder group in a direction so as to lean the operating mixture and said air ratio lambda being modified for an other cylinder group in a direction so as to enrich the operating mixture while at the same time holding the mean air ratio of the operating mixture conducted to all cylinders at least approximately constant;

a second step of detecting the reaction of the engine to said signals as manifested by a change of an output quantity; and, a third step of influencing the efficiency of the individual cylinder groups of the engine pursuant to the results of the second step.

2. The method of claim 1, said third step including changing the air ratio for the specific cylinder group for each one of said groups.

3. The method of claim 2, the air ratio for the specific cylinder group being oppositely changed.

4. The method of claim 1, comprising comparing said change of the output quantity as a reaction of the engine in said first step to a threshold value.

5. The method of claim 4, comprising storing the lambda values specific for each group of cylinders after said output quantity change of the engine drops below said threshold value.

6. The method of claim 4, comprising storing the amplitude of the time-dependent signals after said output quantity change of the engine drops below said threshold value.

7. The method of claim 4, comprising storing the duration of injection after said output quantity change of the engine drops below said threshold value.

8. The method of claim 1, comprising repeatedly applying said steps to different cylinder groups whereby the number of applications is at least determined by the number of cylinders.

9. The method of claim 1, comprising combining the cylinder groups from different cylinders whereby the number of the combinations is determined at least by the number of the cylinders.

10. The method of claim 1, said first step including influencing the air ratio lambda specific for each group of cylinders by varying the quantity of fuel delivered to the cylinder groups while the inducted air is held approximately constant.

11. The method of claim 10, wherein the metered fuel is injected by means of at least a fuel injection valve and is varied over the duration of injection and the time point of injection.

12. The method of claim 11, comprising oppositely modifying the durations or points of injection specific for each group of cylinders so that the total of the durations of injection as the sum of the individual durations of injection of the individual cylinders takes on a constant value.

13. The method of claim 10, wherein the metered fuel is injected by means of at least a fuel injection valve and is varied over the duration of injection.

14. The method of claim 13, comprising oppositely modifying the durations or points of injection specific for each group of cylinders so that the total of the durations of injection as the sum of the individual durations of injection of the individual cylinders takes on a constant value.

15. The method of claim 10, wherein the metered fuel is injected by means of at least a fuel injection valve and is varied over the time point of injection.

16. The method of claim 15, comprising oppositely modifying the durations or points of injection specific for each group of cylinders so that the total of the durations of injection as the sum of the individual durations of injection of the individual cylinders taken on a constant value.

17. The method of claim 1, comprising detecting a change in the torque of the engine in said second step.

18. The method of claim 17, comprising utilizing the rotational speed of the engine as an output quantity.

19. The method of claim 1, comprising precontrolling, by means of a characteristic field, the air ratio lambda of the operating mixture which is conducted to the engine.

20. The method of claim 19, comprising adapting the characteristic field values specific for each group of cylinders.

21. The method of claim 1, comprising controlling the mean air ratio of the operating mixture conducted to all cylinders to a value adjustable in dependence upon operating parameters.

22. Apparatus for carrying out a method of controlling operating characteristic quantities of a multi-cylinder internal combustion engine with a control strategy for optimizing the efficiency of the engine, the apparatus comprising:

microcomputer and peripheral equipment means for optimizing the efficiency of the engine;

first function means for generating time-dependent signals for modifying the air ratio lambda of the operating mixture conducted to at least any two desired groups of cylinders wherein each group includes at least one cylinder, said first function means including means for modifying said air ratio lambda for one cylinder group in a direction so as to lean the operating mixture and said air ratio lambda being modified for another cylinder group in a direction so as to enrich the operating mixture while at the same time holding the mean air ratio of the operating mixture conducted to all cylinders at least approximately constant;

second function means for detecting the reaction of the engine to said signals of said first function means as manifested by a change of an output quantity; and, third function means for influencing the efficiency of the individual cylinder groups of the engine pursuant to the results obtained from said second function means.

* * * * *